US011257645B2

(12) United States Patent
Joyce et al.

(10) Patent No.: US 11,257,645 B2
(45) Date of Patent: Feb. 22, 2022

(54) RELAY DRIVE WITH POWER SUPPLY ECONOMIZER

(71) Applicant: Hamilton Sundstrand Corporation, Charlotte, NC (US)

(72) Inventors: Thomas P. Joyce, Rockford, IL (US); Mike Arthur, Huntley, IL (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 0 days.

(21) Appl. No.: 16/741,014

(22) Filed: Jan. 13, 2020

(65) Prior Publication Data

US 2021/0217570 A1 Jul. 15, 2021

(51) Int. Cl.
*H01H 47/18* (2006.01)
*H01H 47/32* (2006.01)

(52) U.S. Cl.
CPC ..... *H01H 47/325* (2013.01); *H01H 47/18* (2013.01)

(58) Field of Classification Search
CPC .... H02M 1/32; H02M 1/36; H02M 2005/293; H02M 2003/1555; H02M 5/293; H02M 7/2176; H02M 7/06; H01H 9/542; H01H 9/56; H01H 9/001; H01H 9/02; H01H 9/025; H01H 47/32; H01H 47/22; H01H 47/002; H01H 47/226; H01H 47/325; H01H 47/04; H01H 2300/052; H02H 3/10; H02H 3/04; H02H 3/044; H02H 3/06; H02H 1/06
See application file for complete search history.

(56) References Cited

U.S. PATENT DOCUMENTS

| | | | | |
|---|---|---|---|---|
| 3,590,334 | A | 6/1971 | Baker | |
| 4,415,943 | A | 11/1983 | Wortman | |
| 6,459,554 | B1 * | 10/2002 | Meiners | H01H 47/32 327/306 |
| 7,315,440 | B1 | 1/2008 | Guo | |
| 8,559,154 | B2 | 10/2013 | Li et al. | |
| 2004/0169987 | A1 | 9/2004 | Green | |
| 2011/0227622 | A1 * | 9/2011 | Kang | H03K 5/1565 327/165 |

(Continued)

FOREIGN PATENT DOCUMENTS

WO 2014109745 A2 7/2014

OTHER PUBLICATIONS

Extended European Search Report dated May 10, 2021 for Application No. 20216400.0.

*Primary Examiner* — Bryan R Perez
(74) *Attorney, Agent, or Firm* — Cantor Colburn LLP

(57) ABSTRACT

Provided are embodiments for a circuit for a relay drive with a power supply economizer. The circuit includes a relay having a relay coil and a relay contact. The circuit also includes a power source to generate power for a coil drive voltage to operate the relay, and a controller configured to provide a command signal to operate the circuit in a plurality of modes. The circuit includes a first gate drive coupled to a first switch, wherein the first switch connects the relay coil to the circuit, and a second gate drive coupled to a second switch, wherein the second switch changes an effective resistance of a resistor network of the circuit to modify the coil drive voltage. Also provided are embodiments for a method for operating a circuit including relay drive with a power supply economizer.

17 Claims, 3 Drawing Sheets

(56) References Cited

U.S. PATENT DOCUMENTS

2013/0119958 A1* 5/2013 Gasperi ..... H02M 1/10
323/299
2015/0348729 A1* 12/2015 Colby ..... H01H 47/04
361/160

* cited by examiner

200

Controller 110

RELAY DRIVE WITH POWER SUPPLY ECONOMIZER

BACKGROUND

Embodiments pertain to the art of electric circuits, and in particular to a relay drive with a power supply economizer.

Relays are common electrical components that function as electric switches for many different types of applications. Relays receive a drive signal that is used to connect or disconnect the load from the circuit. Various types of relays include normally closed and normally open relays. A normally closed relay remains closed and connects the load to the circuit during a de-energized state. A normally open relay remains open and the load is disconnected from the circuit during a de-energized state. There may be a need to efficiently dissipate power and thermal rise of the relay and associated components of the circuit.

BRIEF DESCRIPTION

According to an embodiment, a circuit for a relay drive with a power supply economizer is provided. The circuit includes a relay including a relay coil and a relay contact; a power source to generate power for a coil drive voltage to operate the relay; a controller configured to provide a command signal to operate the circuit in a plurality of modes; a first gate drive coupled to a first switch, wherein the first switch connects the relay coil to the circuit; and a second gate drive coupled to a second switch, wherein the second switch changes an effective resistance of a resistor network of the circuit to modify the coil drive voltage.

In addition to one or more of the features described herein, or as an alternative, further embodiments include a normally-closed relay.

In addition to one or more of the features described herein, or as an alternative, further embodiments include a relay that is actuated at a first voltage level and operated in steady-state at a second voltage, wherein the first voltage level is greater than the second voltage level.

In addition to one or more of the features described herein, or as an alternative, further embodiments include a voltage regulator that is configured to regulate the coil drive voltage.

In addition to one or more of the features described herein, or as an alternative, further embodiments include a delay circuit that is coupled to the second gate drive that controls the second switch, wherein the delay circuit is configured to delay the command signal to switch the second switch after the first switch.

In addition to one or more of the features described herein, or as an alternative, further embodiments include a delay circuit that includes a comparator, a delay resistor, and a delay capacitor.

In addition to one or more of the features described herein, or as an alternative, further embodiments include using a non-inverting input of the comparator that is configured to receive the command signal from the controller, and an inverting input of the comparator is configured to provide a reference voltage.

According to an embodiment, a method for operating a circuit including relay drive with a power supply economizer is provided. The method includes receiving power to operate the circuit; regulating, via a voltage regulator, a coil drive voltage for a relay of the circuit; and receiving a command signal, from a controller, to operate the circuit in one of a plurality of modes; wherein the coil drive voltage is operable to operate the circuit at a first voltage level and a second voltage level, the first voltage level is greater than the second voltage level.

In addition to one or more of the features described herein, or as an alternative, further embodiments include using a first voltage level to actuate the relay, and the second voltage level to hold the relay in a steady-state.

In addition to one or more of the features described herein, or as an alternative, further embodiments include providing a command signal, from the controller, to a first gate drive that controls a first switch and a delay circuit coupled to a second gate drive that controls a second switch simultaneously.

In addition to one or more of the features described herein, or as an alternative, further embodiments include when the command signal operates the circuit in a first mode, a first switch for connecting a coil of the relay and a second switch for coupling a resistor in parallel to reduce the coil drive voltage are OPEN.

In addition to one or more of the features described herein, or as an alternative, further embodiments include when the command signal operates the circuit in a second mode, the first switch is CLOSED and the second switch is OPEN.

In addition to one or more of the features described herein, or as an alternative, further embodiments include when the command signal operates the circuit in a third mode, the first switch and the second switch are CLOSED.

In addition to one or more of the features described herein, or as an alternative, further embodiments include operating in a third mode that reduces the coil drive voltage provided to the relay.

In addition to one or more of the features described herein, or as an alternative, further embodiments include using a second switch to change an effective resistance of the coil drive voltage by coupling a resistor in parallel to a resistor network at the output of the voltage regulator.

In addition to one or more of the features described herein, or as an alternative, further embodiments include when the command signal operates the circuit in a fourth mode, the first switch and the second switch are OPENED.

In addition to one or more of the features described herein, or as an alternative, further embodiments include disconnecting the resistor in parallel from the resistor network responsive to receiving the command signal In addition to one or more of the features described herein, or as an alternative, further embodiments include delaying, using a delay circuit, the closing of the second switch to reduce the coil drive voltage during operation.

In addition to one or more of the features described herein, or as an alternative, further embodiments include disconnecting and opening the first switch and the second switch coupled to the delay circuit in the circuit without delay.

In addition to one or more of the features described herein, or as an alternative, further embodiments include a linear voltage regulator.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
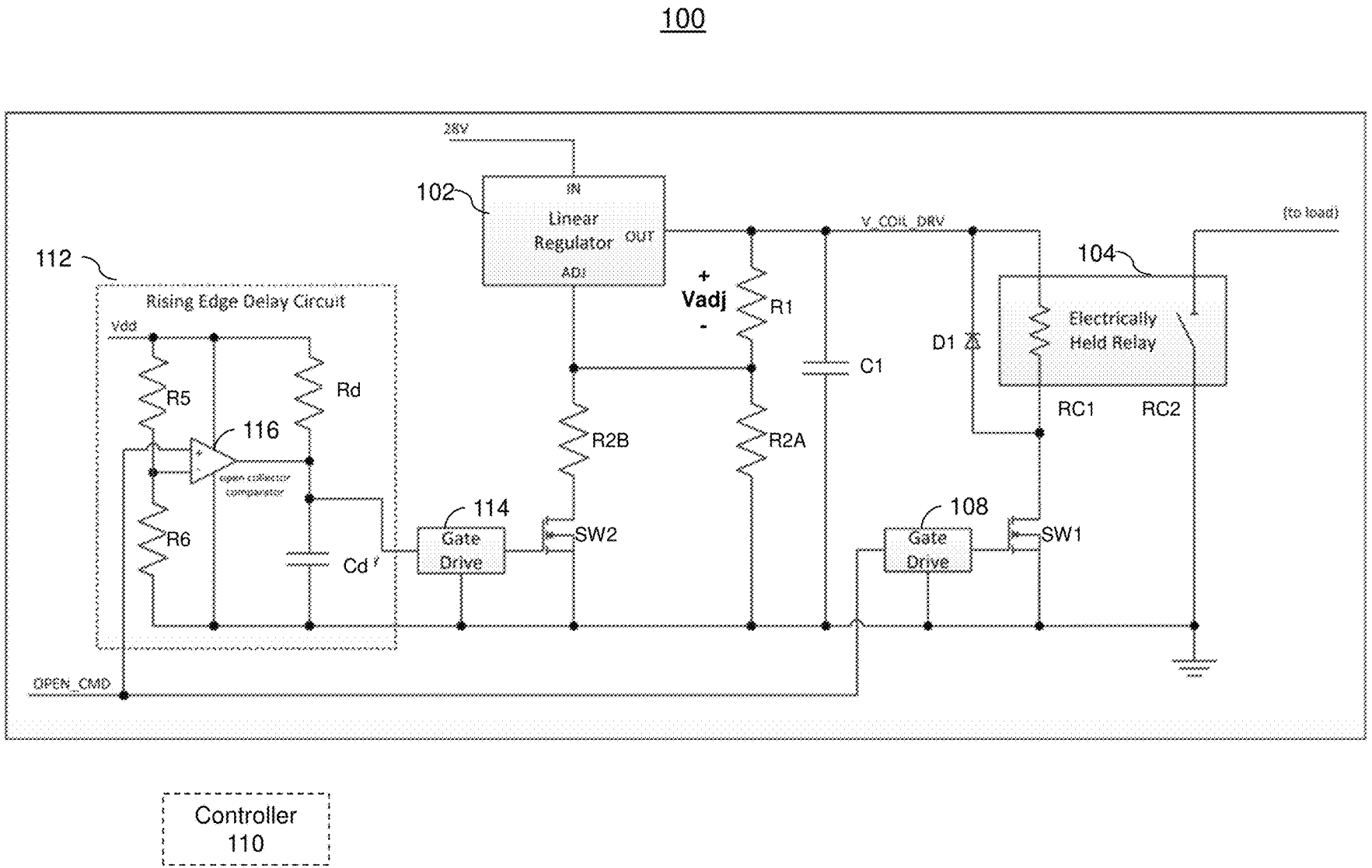
FIG. 1 depicts an architecture for a circuit having a relay drive with a power supply economizer in accordance with one or more embodiments.

Electrically held relays are common components used as electrical switches across many industries. Among many applications for relays is the case in which a switch needs to be closed in its default state even when its control circuitry is unpowered. In this case, there exists the normally closed relay which closes its contact in the de-energized state and opens its contact in the energized state. The normally closed relay presents the advantage over normally closed solid-state switches in that the output (contact) side dissipates negligible power and can withstand relatively large current, whereas normally closed solid-state technology has limited capability to carry large current.

Large contact current rating of the relays can drive designs to choose relays for normally closed switch applications, but relays come with design challenges, among them being power dissipation and thermal rise. Relay contacts actuate between a closed state and an open state. The relays can transition between these states based on a magnetic field developed due to electrical current through the relay's inductive coil. Large current in the relay coil produces a large magnetic field for stronger contact actuation, and therefore, relays commonly require a relatively large applied coil voltage and coil current in order to guarantee a reliable contact change in state. The current in the relay coil causes power dissipation in both the relay itself and in the power supply that is powering the coil, and this power dissipation can be substantial enough to cause thermal problems when operated in harsh environments in which the ambient temperature is already hot. The magnetic field strength required to transition a relay contact out of its de-energized state is larger than the magnetic field strength required to hold it there, and therefore some relays can be reliably operated with a larger coil voltage applied during the contact transition than the coil voltage applied in steady-state after the transition has fully occurred.

It is desirable for some relays to switch to a mode in which a lower voltage is applied to the coil after the coil has been energized and the relay contact has fully transitioned its state. A lower applied coil voltage causes lower coil current which causes both a weaker magnetic field and less power dissipation in the relay and its power supply. The weaker magnetic field is acceptable as previously discussed because less field strength is required to hold the contact position after the contact has transitioned, and the lower power dissipation is desirable for improved thermal performance.

This disclosure presents a circuit design which controls the applied relay coil voltage in order to optimize power dissipation and thermal performance of the circuit. The techniques described herein apply a higher coil voltage during the initial energization of the relay and apply a lower voltage for steady-state in order to optimize power dissipation and thermal performance of the relay and its power supply.

Now referring to FIG. 1, an architecture for a circuit 100 having a relay drive with a power supply economizer in accordance with one or more embodiments is shown. The circuit 100 includes a linear regulator 102 that is connected to a power source (not shown) and is configured to provide a dedicated power supply, such as the coil drive voltage (V_Coil_Drv) for controlling the relay 104. The linear regulator 102 which receives an input (IN) signal from a power source and provides an output (OUT) signal to the relay 104.

The output (OUT) signal provides the coil voltage (V_Coil_Drv) of the linear regulator 102 is determined by the ratio of the resistors R1 and R2A by the following relationship shown in Equation 1:

$$V_{COIL_{DRIVE}} = Vadj * \left(1 + \frac{R2}{R1}\right) \quad \text{(Eq. 1)}$$

where, in a non-limiting example, Vadj=1.25V. The value of R2 depends on the circuit's mode of operation. For example, R2 is equal to either the value of the resistors R2A or the value of resistor R2A in parallel with resistor R2B.

The linear regulator 102 also receives a feedback signal using a voltage divider including resistors (R1, R2, where the value of R2 depends on the circuit's mode of operation). The feedback signal is received at the adjustment (ADJ) input of the linear regulator 102 to adjust and regulate the output (OUT) signal provided to the relay 104.

The relay 104 includes a relay coil RC1 (represented by a resistor) and relay contact RC2. The coil RC1 is connected to a first switch SW1 that is used to control the connection of a load to the circuit 100. The current that flows through the relay coil RC1 generates a magnetic field that controls the opening and closing of the relay contact RC2. The current that flows through the relay coil RC1 is controlled by the switch SW1, the switch SW1 is controlled by a first gate drive 108. When the switch SW1 is closed, the relay 104 is opened, and when the SW1 is open, the relay 104 is closed allowing for the load (not shown) to be connected to the circuit 100. It is to be understood that the techniques that are described herein can be provided for any type of electrically held relay and is not limited by the circuit shown in FIG. 1.

A controller 110 is shown and is configured to provide a command signal to change the mode of operation of the relay 104 and circuit 100. In one or more embodiments, a command signal, such as an Open_CMD, is provided from the controller 110 to a gate drive 108 to directly control the switch SW1 to provide a complete electrical path for the relay coil RC1. In a non-limiting example, a high signal can be used to close the switch SW1 and a low signal can be used to disconnect open the switch SW1. In another embodiment, the command signal from the controller 110 can be provided to another circuit or component such as a delay circuit (Rising Edge Delay Circuit 112 discussed further below) to delay the operation of a gate drive that is coupled to a switch.

The gate drive 108, 114 are power amplifiers that are configured to receive a low power input from a controller 110 and produce a high power output (a high voltage or high current) to control a connected high power device such as an IGBT or MOSFET. The gates of each the switches SW1 and SW2 receive the signal from the first gate drive 108 and the second gate drive 114, respectively.

In one or more embodiments, FIG. 1 can include a rising edge delay circuit 112. In a non-limiting example, the rising edge delay circuit 112 includes a comparator 116. The inverting input of the comparator 116 is coupled to a resistor network (resistors R5, R6) and the non-inverting input of the comparator 116 receives a command signal from the controller 110. The comparator 116 compares the inverting input and the non-inverting input and provides an output based on the comparison of the input signals. The output of the rising edge delay circuit 112 includes a delay resistor Rd and delay capacitor Cd to delay the signal provided to the gate drive 114 that controls a switch SW2. The switch SW2 is configured to connect the parallel resistor R2B of the resistor network (resistors R1, R2A) to reduce the effective resistance of R2 from Equation 1 and subsequently reduce the coil drive voltage (V_Coil_Drv) during operation the circuit 100.

The circuit 100 can be operated in a variety of modes which are discussed in further detail below. The modes of operation as described herein provide 4 different modes of operation. However, it should be understood that the circuit 100 can be operated in other modes and is not limited by the modes described in the description.

A first mode (Mode 1) of operation is an initialization mode. During Mode 1, power is first applied to the circuit 100 from the power source. Higher power is required to open the normally closed relay, and it should be noted that when operating in this mode, the higher supply voltage does not cause additional power dissipation because the load coil is not drawing current. In Mode 1, the first gate drive 108 and the second gate drive 114 keep the switches SW1 and SW2, respectively, in the OPEN state. In Mode 1, the coil drive voltage can be calculated according to the following Equation 2:

$$V_{COIL_{DRIVE}} = Vadj*\left(1 + \frac{R2A}{R1}\right) \quad \text{(Eq. 2)}$$

In Mode 2, the command signal from the controller 110 transitions from a low signal to a high signal to disconnect the load from the circuit 100 (for a normally closed relay).

In this mode (Mode 2), the first gate drive 108 is operated to close the first switch SW1 and the second gate drive 114 is operated to keep the second switch open. In one or more embodiments, the second gate drive 114 remains off for a period of time due to the rising edge delay circuit 112. The coil drive voltage is calculated by Equation 1 above.

In Mode 3, the first gate drive 108 and second gate drive 114 are operated to close the first switch SW1 and the second switch SW2, respectively. The second switch SW2 is now ON because the delay period of the rising edge delay circuit 112 has expired. By closing the second switch SW2, the resistor R2A is in parallel with R2B which changes the effective resistance of the resistor network (R2 of Equation 1) at the output of the linear regulator 102. The coil drive voltage can be calculated by the following Equation 3:

$$V_{COIL_{DRIVE}} = Vadj*\left(1 + \frac{R2A \| R2B}{R1}\right) \quad \text{(Eq. 3)}$$

When operating in Mode 3, the coil drive voltage regulates to a lower voltage than in Modes 1 and 2. The lower voltage allows for a lower power dissipation state during steady-state when the relay coil is energized.

The circuit 100 operates in Mode 4, when the command signal from the controller 110 transitions from a high signal to a low signal, the relay contact RC is returned to the closed state to couple the load to the circuit 100. During Mode 4, the first gate drive 108 and the second gate drive 114 are operated to open the switches SW1 and SW2, respectively.

The relay coil RC is immediately de-energized when the command signal from the controller 110 transitions to the low signal, while removing the parallel resistor from the resistor network. That is, the parallel resistor R2B is removed without delay because the switch SW2 is now open. This increases the coil drive voltage that is provided to the relay 104. The coil drive voltage can be calculated by Equation 1 provided above.

This architecture prevents the coil drive power supply from rapidly changing voltage while the relay coil RC is de-energized which can cause charge injection through parasitic capacitance in the control MOSFET and begin to re-energize the coil when it is meant to remain de-energized. Instead, the supply voltage transition occurs during the same time as the coil de-energization. Because this can cause charge injection during the de-energization transition leading to unwanted delay in the transition time, a capacitive filter could be added to the linear regulator control circuit to slow down the supply voltage rise time which would improve the circuit's 100 immunity to the charge injection.

Figure 2:
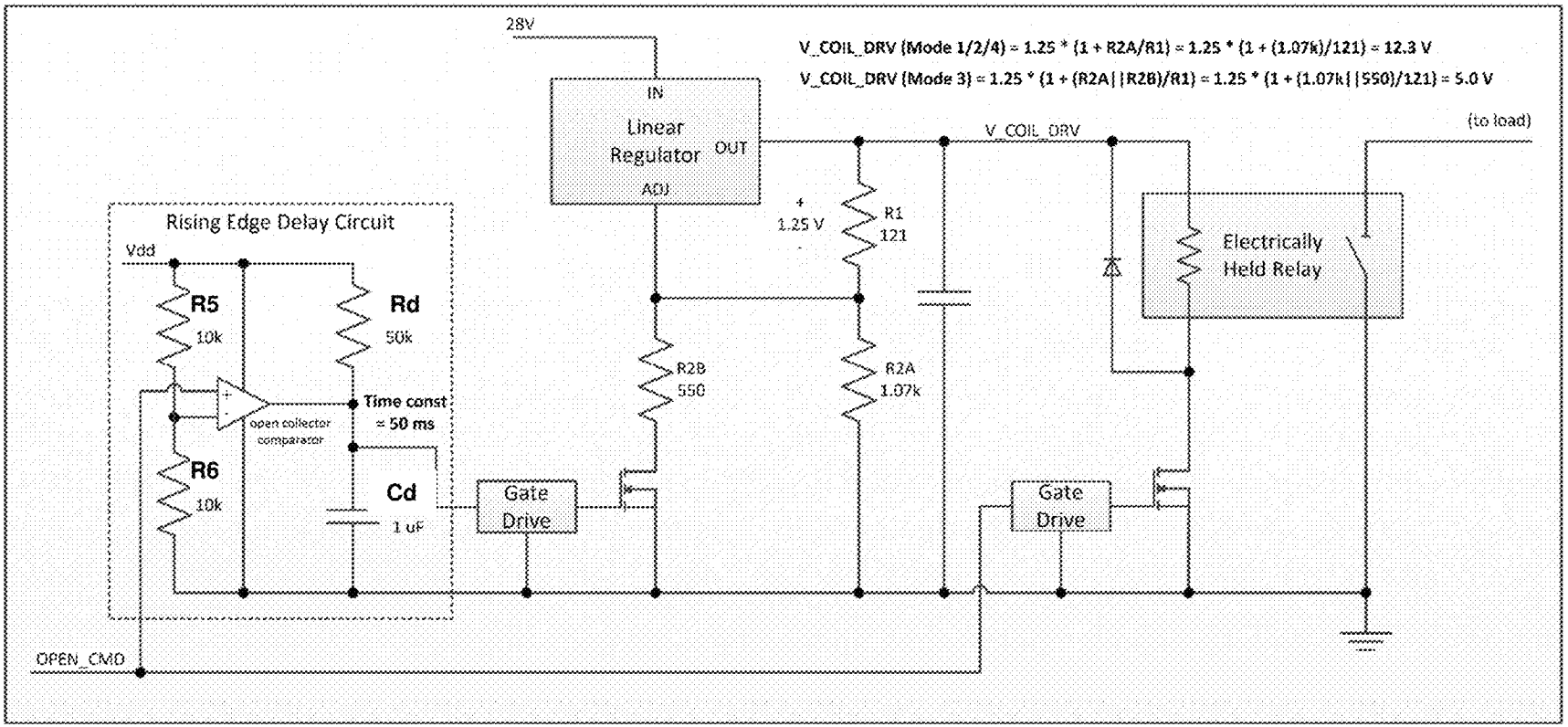
FIG. 2 depicts an example implementation of a circuit having a relay drive with a power supply economizer in accordance with one or more embodiments.

FIG. 2 provides an illustrative example of the relay drive with the power supply economizer circuit. The power supply voltage of 12.3 V can be used when operating in Modes 1, 2, and 4. A lower power supply voltage of 5.0 V can be used for operating in Mode 3. An approximate rising edge delay of 50 ms between the time when the relay coil begins to energize and when the supply voltage is reduced from 12.3 V to 5.0 V.

In this example, if the relay coil has a resistance of 100 ohms, then the power dissipated in the relay coil is reduced from 1.5 W at 12.3 V to 0.25 W at 5.0 V. The power dissipated in the linear regulator drops from a nominal 1.93 W at 12.3 V to a nominal 1.15 W at 5.0 V.

Figure 3:
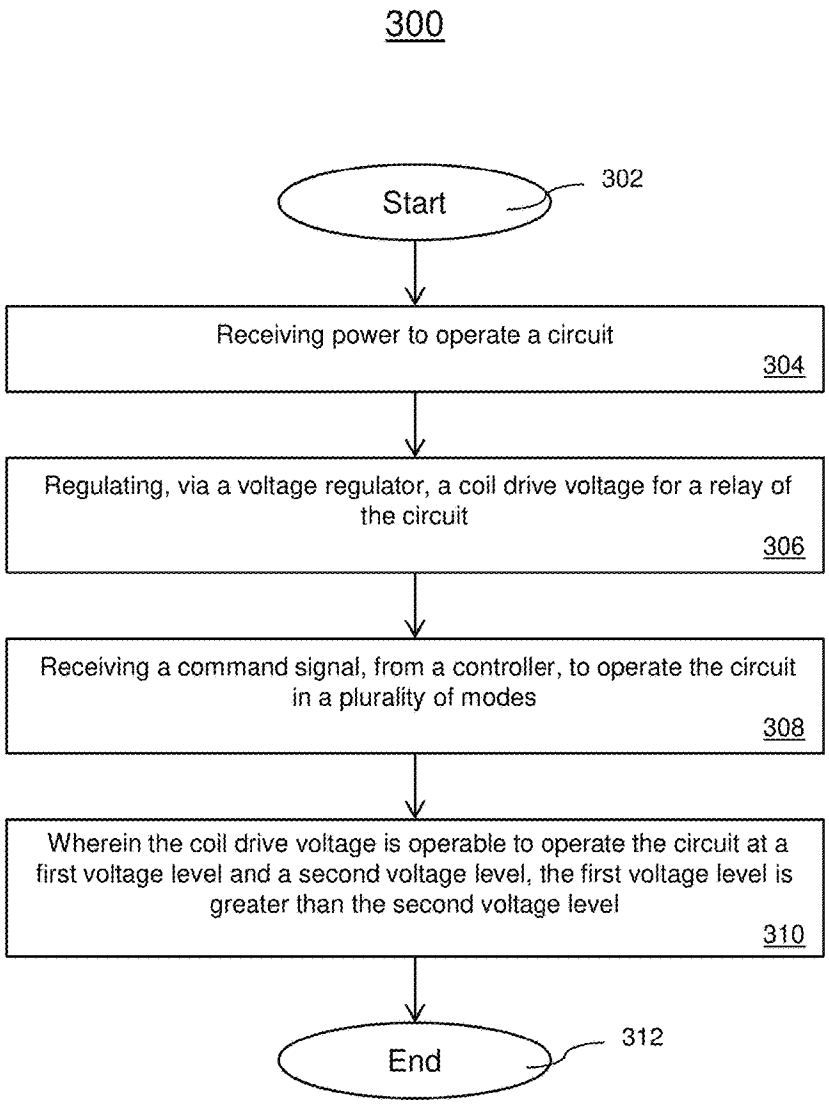
FIG. 3 depicts a flowchart of a method for operating a relay drive with a power supply economizer in accordance with one or more embodiments.

Now referring to FIG. 3, a flowchart of a method 300 for operating a relay drive with the power supply economizer circuit in accordance with one or more embodiments is shown. The method 300 can be implemented by the circuit 100 and 200, but it should be understood the examples are not intended to be limiting. The method 300 begins at block 302 and proceeds to block 304 which provides for receiving power to operate a circuit.

Block 306 regulates, via a voltage regulator, a coil drive voltage for a relay of the circuit. In one or more embodiments, the voltage regulator is a linear voltage regulator. Block 308 receives a command signal, from a controller, to operate the circuit in one of a plurality of modes. In one or more embodiments, the command signal is provided from a controller to a gate drive coupled to a switch to change the coil voltage by connecting/disconnecting a parallel resistor to a resistor network. In some embodiments, a delay circuit is used to prevent unwanted or unnecessary switching during operation.

Block 310 provides wherein the coil drive voltage is operable to operate the circuit at a first voltage level and a second voltage level, the first voltage level is greater than the second voltage level. The first voltage level is used to actuate the relay to OPEN the relay contact (normally closed relay). The second voltage level is to maintain the current position of the relay contact which requires less power. The second voltage level is achieved by changing the effective resistance of a resistor network for the coil drive voltage. The method 300 ends at block 312.

The techniques described herein provide an efficient solution for reducing power dissipation and thermal rise for a relay by operating a normally closed relay in a transition mode (high-voltage mode) and a hold mode (low-voltage mode).

A detailed description of one or more embodiments of the disclosed apparatus and method are presented herein by way of exemplification and not limitation with reference to the Figures.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A circuit for a relay drive with a power supply economizer, the circuit comprising:

a relay comprising:

a relay coil and a relay contact;

a power source to generate power for a coil drive voltage to operate the relay;

a controller configured to provide a command signal to operate the circuit in a plurality of modes;

a first gate drive coupled to a first switch, wherein the first switch connects the relay coil to the circuit, wherein the first gate drive amplifies a signal to the first switch;

a second gate drive coupled to a second switch, wherein the second switch changes an effective resistance of a resistor network of the circuit to modify the coil drive voltage, wherein the second gate drive amplifies a signal to the second switch;

a voltage regulator configured to regulate the coil drive voltage, wherein the voltage regulator is coupled to a voltage divider that senses an output of the voltage regulator and the second switch; and a delay circuit that is coupled to the second gate drive and is configured to delay a signal to switch the second switch connected to the resistor network after the first switch, wherein the delay circuit and the first gate drive simultaneously receive the command signal from the controller.

2. The circuit of claim 1, wherein the relay is a normally-closed relay.

3. The circuit of claim 1, wherein the relay is actuated at a first voltage level and operated in steady-state at a second voltage, wherein the first voltage level is greater than the second voltage level.

4. The circuit of claim 1, wherein the delay circuit comprises a comparator, a delay resistor, and a delay capacitor.

5. The circuit of claim 4, wherein a non-inverting input of the comparator is configured to receive the command signal from the controller, and an inverting input of the comparator is configured to provide a reference voltage.

6. A method for operating a circuit including relay drive with a power supply economizer, the method comprising:

receiving power to operate the circuit;

regulating, via a voltage regulator, a coil drive voltage for a relay of the circuit, wherein the voltage regulator receives feedback from a voltage divider connected to an output of the voltage regulator to regulate the coil drive voltage; and receiving a command signal, from a controller, to operate the circuit in one of a plurality of modes;

providing a first gate drive that controls a first switch coupled to a relay coil, wherein the first gate drive amplifies a signal to the first switch;

wherein the coil drive voltage is operable to operate the circuit at a first voltage level and a second voltage level, the first voltage level is greater than the second voltage level, wherein the command signal, from the controller, is simultaneously provided to the first gate drive that controls the first switch coupled to the relay coil and a delay circuit coupled to a second gate drive that controls a second switch coupled to the voltage divider connected to the voltage regulator.

7. The method of claim 6, wherein the first voltage level actuates the relay, and the second voltage level holds the relay in a steady-state.

8. The method of claim 6, wherein when the command signal operates the circuit in a first mode, the first switch for connecting a coil of the relay and a second switch for coupling a resistor in parallel to reduce the coil drive voltage are OPEN.

9. The method of claim 6, wherein when the command signal operates the circuit in a second mode, the first switch is CLOSED and the second switch is OPEN.

10. The method of claim 6, wherein when the command signal operates the circuit in a third mode, the first switch and the second switch are CLOSED.

11. The method of claim 10, wherein the third mode reduces the coil drive voltage provided to the relay.

12. The method of claim 11, wherein the second switch changes an effective resistance of the coil drive voltage by coupling a resistor in parallel to a resistor network at the output of the voltage regulator.

13. The method of claim 6, wherein when the command signal operates the circuit in a fourth mode, the first switch and the second switch are OPENED.

14. The method of claim 13, responsive to receiving the command signal the resistor in parallel is disconnected from the resistor network.

15. The method of claim 6, further comprising delaying, using a delay circuit, closing of the second switch to reduces the coil drive voltage during operation.

16. The method of claim 15, further comprising disconnecting and opening the first switch and the second switch coupled to the delay circuit in the circuit without delay.

17. The method of claim 6, wherein the voltage regulator is a linear voltage regulator.

* * * * *